United States Patent [19]

Bettcher et al.

[11] Patent Number: 5,070,540

[45] Date of Patent: Dec. 10, 1991

[54] PROTECTIVE GARMENT

[75] Inventors: William H. Bettcher, Vermilion; Laurence A. Bettcher, Huron, both of Ohio

[73] Assignee: Bettcher Industries, Inc., Birmingham, Ohio

[21] Appl. No.: 70,613

[22] Filed: Jul. 9, 1987

Related U.S. Application Data

[63] Continuation of Ser. No. 768,919, Aug. 23, 1985, abandoned, which is a continuation of Ser. No. 474,466, Mar. 11, 1983, abandoned.

[51] Int. Cl.[5] ..... A41D 13/04; A41D 13/08; A41D 13/10; B32B 25/04; B32B 31/12

[52] U.S. Cl. ..... 2/2.5; 2/16; 2/48; 2/49 R; 2/51; 2/161 R; 2/167; 2/168; 57/210; 57/230; 57/902; 156/165; 156/212; 156/214; 156/242; 156/305; 428/229; 428/248; 428/251; 428/252; 428/253; 428/911

[58] Field of Search ..... 2/161 R, 167, 168, 2.5, 2/16, 48, 49, 51; 156/165, 212, 214, 242, 305; 428/229, 248, 251, 252, 253, 911

[56] References Cited

U.S. PATENT DOCUMENTS

| | | | |
|---|---|---|---|
| 831,108 | 9/1906 | Ryder . | |
| 2,126,723 | 8/1938 | Bodle | 2/168 |
| 2,165,296 | 7/1939 | Dass . | |
| 2,313,058 | 3/1943 | Francis | 66/202 |
| 2,327,625 | 8/1943 | Dickson | 2/168 |
| 2,373,940 | 4/1945 | Beall | 2/168 |
| 2,657,391 | 11/1953 | Crandon | 2/161 |
| 2,737,663 | 3/1956 | Harris | 2/161 |
| 2,849,786 | 9/1958 | Ashley et al. . | |
| 2,864,091 | 12/1958 | Schneider | 2/161 |
| 2,988,457 | 6/1961 | Gatcomb . | |
| 2,999,764 | 9/1961 | Rhoades . | |
| 3,026,531 | 3/1962 | Holaday | 2/167 |
| 3,087,699 | 4/1963 | Foster . | |
| 3,277,564 | 10/1966 | Webber et al. . | |
| 3,288,175 | 11/1966 | Valko | 139/425 |
| 3,357,636 | 9/1944 | David | 2/48 |
| 3,490,224 | 1/1970 | Bourgeas . | |
| 3,572,397 | 3/1971 | Austen | 139/426 |
| 3,594,817 | 7/1972 | Kelly | 2/23 |
| 3,699,590 | 10/1972 | Webber et al. | 2/73 |
| 3,732,575 | 5/1973 | Pakulak | 2/161 |
| 3,871,946 | 3/1975 | Romanski . | |
| 3,883,898 | 5/1975 | Byrnes | 2/167 |
| 3,916,448 | 11/1975 | Hamel | 2/161 |
| 3,945,049 | 3/1976 | Barlow | 2/167 |
| 3,986,530 | 10/1976 | Meakawa | 66/202 |
| 4,001,895 | 1/1977 | Cohen | 2/161 |
| 4,004,295 | 1/1977 | Byrnes | 2/161 |
| 4,016,714 | 4/1977 | Crandall et al. . | |
| 4,172,229 | 10/1979 | Vistins | 2/169 |
| 4,172,293 | 10/1979 | Vistins | 2/169 |
| 4,218,779 | 8/1980 | Hart et al. . | |
| 4,302,851 | 12/1981 | Adair | 2/158 |
| 4,356,569 | 11/1982 | Sullivan | 2/2.5 |
| 4,359,783 | 11/1982 | Andrews | 2/161 |
| 4,384,449 | 5/1983 | Byrnes | 57/210 |
| 4,454,611 | 6/1984 | Tschirch et al. | 2/161 |
| 4,470,251 | 9/1984 | Bettcher | 57/230 |
| 4,526,828 | 7/1985 | Fogt et al. | 428/229 |

FOREIGN PATENT DOCUMENTS

| | | |
|---|---|---|
| 1610495 | 9/1967 | Fed. Rep. of Germany . |
| 2336200 | 2/1974 | Fed. Rep. of Germany . |
| 3023990 | 2/1982 | Fed. Rep. of Germany . |
| 1539816 | 8/1968 | France . |
| 187327 | 10/1922 | United Kingdom . |
| 1401378 | 2/1973 | United Kingdom . |

OTHER PUBLICATIONS

Webber, "Metal Fibers", *Modern Textiles*, pp. 72–75, May 1966.

Barry, "Textile Applications of Metal Fibers", *Modern Textiles*, pp. 53–56, Jun. 1967.

Allen, "Textile Applications for Fine Metallic Filaments", *Modern Textile*, pp. 60–61, Mar. 1974.

Reexamination Certificate B1 4,526,828, issued 4/4/89.

*Primary Examiner*—James C. Cannon

*Attorney, Agent, or Firm*—Watts Hoffmann Fisher & Heinke

[57] ABSTRACT

A protective garment 10, such as a glove, arm guard or the like of wire 24 and fiber strands 26, 28, 30 and an elastomeric coating 16. The preferred garment is knitted from yarn 12 having a core 22 of one or more wire strands 24 and a fiber strand 26, and two wrappings of fiber strands 28, 30, preferably polyester. The knitted garment is coated, preferably by dipping in nitrile rubber, and the coating is cured in place. The garment is highly cut-resistant, nonabsorbent, highly slip-resistant, liquid in weight and flexible.

30 Claims, 1 Drawing Sheet

PROTECTIVE GARMENT

This is a continuation of co-pending U.S. Pat. application Ser. No. 06/768,919 filed on 08/23/85, and now abandoned, which is a continuation of U.S. Pat. application Ser. No. 474,466, filed 03/11/83, and now abandoned.

TECHNICAL FIELD

The invention relates to protective garments made of wire and fiber strands and an elastomeric coating.

BACKGROUND ART

Cut-resistant garments have been proposed of steel wire and aramid fiber. A cut-resistant knitted glove has been made of yarn having a core of two stainless steel strands and a strand of aramid fiber, overwrapped in opposite directions with aramid fiber strands or with an aramid strand and a covering strand of nylon (polyamide). Aramid fiber is strong and cut-resistant, and such a glove is extremely effective and useful in protecting against injury from sharp products or tools, e.g., in cutting and processing meat products; yet, the aramid yarn is somewhat abrasive (self abrasive, causing wear, and also abrasive or harsh to the feel), tends to absorb dirt, fat, blood or other fluids, and is not as easily cleaned as might be desired. Moreover, detergents, light and water tend to break down aramid fiber. In addition, aramid fiber, which accounts for much of the strength and cut-resistance of the glove, is relatively expensive. Utilizing a covering nylon strand in forming the yarn diminishes the above disadvantages, but greater improvement is still desired. For example, such a glove still is not liquid or moisture proof, slip resistant or heat resistant. Due to one or a combination of these shortcomings, the market for the present gloves is limited. The glove industry, in particular, has long sought a satisfactory liquid-proof cut and heat-resistant glove that is light-weight, comfortable and reasonably priced.

DISCLOSURE OF THE INVENTION

The present invention provides a high strength, flexible, relatively light-weight garment of substantially improved cut-resistance, that is moisture and oil resistant, nonabsorbent, slip resistant, durable, comfortable to wear and use, and economical to manufacture.

A garment embodying the invention is, at least in part, made of wire and fiber strands associated together and, at least in part, covered by an adhering elastomeric coating. In the preferred embodiment the coating is cured or solidified in place.

Advantageously, the wire and fiber strands are associated in a yarn from which the garment is made. For the greatest comfort and flexibility, the garment is knitted from the yarn. The yarn is formed of a core of one or more strands of wire, advantageously stainless steel wire, and a parallel strand of fiber, preferably synthetic fiber and advantageously polyester fiber, and at least two overwrappings of fiber, preferably synthetic fiber in the form of a thread or strand, of which polyester is most preferred, wound one on top of the other, in opposite directions, about the core.

A garment is knitted from the yarn and coated with a suitable elastomeric material, as by dipping the garment to coat one surface, e.g., the outside surface of a glove, and allowing the coating material to cure in situ, i.e., in place. The coating material must be flexible and have some stretch, be tough, strong, moisture proof, slip resistant, and have good wearing characteristics. Nitrile rubber is particularly suitable. Slip resistance can be improved by incorporating abrasive particles into or onto the coating material.

A garment constructed as described has substantially improved cut-resistance by virtue of the coating Most surprising is the fact that, while a garment knitted from an aramid and steel wire yarn, and uncoated, has greater cut-resistance than an uncoated garment made from a similarly constructed yarn using other synthetic or natural fibers, such a garment does not maintain that advantage over a garment of yarn using polyester fibers when the garments are coated. In addition, it is difficult to adhere a suitable coating on aramid and polyamide yarn.

Preferably, the garment incorporates a cloth liner that is adhered to the knitted yarn by the coating, which "strikes through" the knitted yarn when it is applied, which is typically accomplished by dipping.

A preferred product and yarn embodying this invention is a protective glove of knitted yarn covered with a coating of elastomeric material cured in place and having a fabric liner bonded in place with the coating, said yarn having a core comprised of four strands of stainless steel wire about 0.003 inch in diameter and a parallel core of synthetic polymer fiber having a denier of 800 to 1500, the overall diameter of said core wire being no greater than 0.020 inch, and said yarn having two strands of polyester fiber having a denier of 210 to 630 wrapped about the core in opposite directions one on top of the other, the total diameter of the yarn being no greater than about 0.050 inch, said glove being highly cut-resistant, nonabsorbent to dirt, fat, blood and the like, with high slip resistance and good feel to the wearer, and light in weight, stretchable and flexible.

The above and other features and advantages of the invention will become better understood from the detailed description that follows, when considered in connection with the accompanying drawings.

BEST MODE FOR CARRYING OUT THE INVENTION

Figure 1:
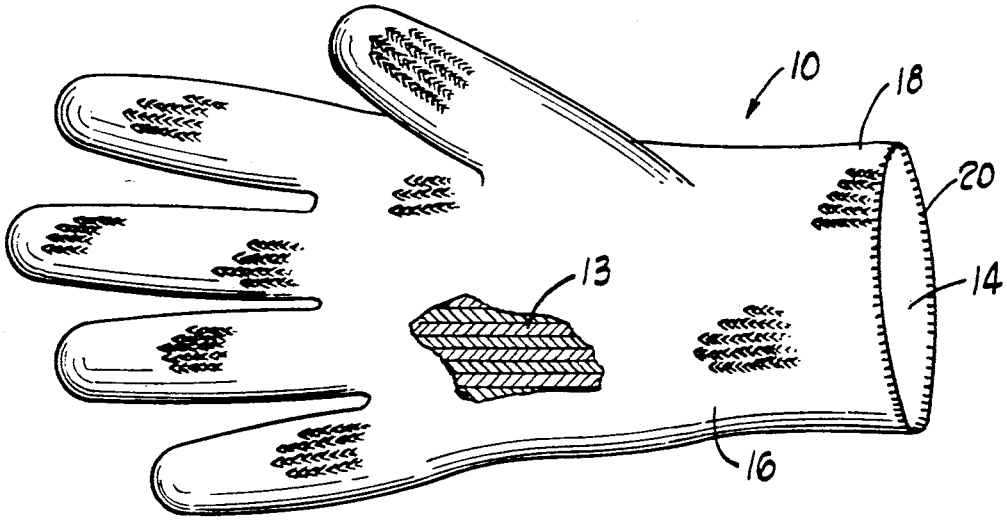
FIG. 1 is a front elevational view of a glove embodying the invention.

A protective garment embodying the present invention is shown in FIG. 1 in the form of a safety or protective glove 10 suitable for a variety of uses in handling sharp or rough-edged objects, such as cut metal and glass and for protection from injury from sharp cutting blades and the like. The glove 10 is especially suitable for operators who process meat, where sharp hand knives are used. The invention can also be embodied in other garments, such as wrist guards, protective sleeves, gaiters, and the like.

Figure 2:
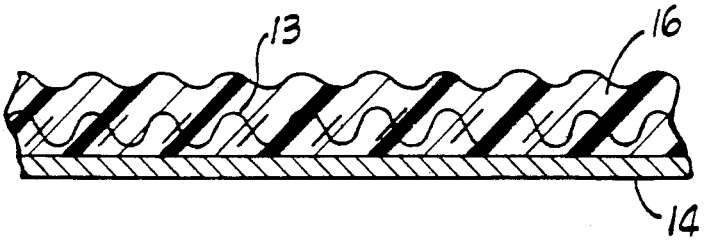
FIG. 2 is a diagrammatic sectional view through a portion of the glove of FIG. 1, showing the construction of the material of which the glove is made.
Figure 3:
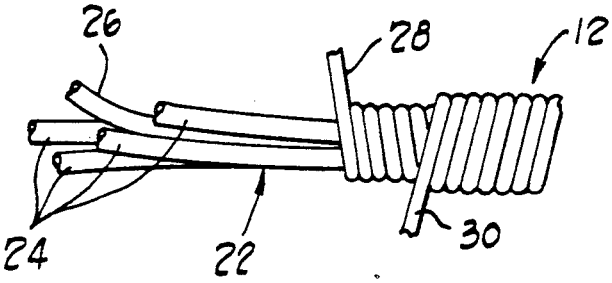
FIG. 3 is a partial elevational view showing the construction of a strand of yarn of which the glove of FIG. 1 is made.

The glove 10 is made from yarn 12, shown in FIG. 3 knitted into a glove shell 13. The preferred glove 10 has a knit cloth liner 14 that is separately made and inserted into the shell 13. An elastomeric coating 16 covers the entire outer surface of the shell, at least up to the edge of a cuff portion 18, where the liner is secured to the knitted glove at the edge of a cuff portion 18 by overcast stitching 20. The coating 16 is preferably applied by dipping the shell 13 and liner together into a suitable coating material in liquid form, removing them from the material and allowing the coating to solidify or cure in place. The coating material strikes through the knitted fabric and secures the liner 14 in place but does not permeate through the liner itself. This is illustrated diagrammatically in FIG. 2.

The yarn 12 is comprised of a core 22 formed of a plurality of parallel wire strands 24 extending the length of the yarn and a parallel fiber strand 26, and two fiber strand overwraps 28, 30, helically wound in opposite directions, the strand 28 being wound directly about the core and the strand 30 being an outer strand wrapped about the strand 28 in an opposite helical direction.

The wire strands 24 are flexible and strong and preferably highly corrosion resistant. Stainless steel is a particularly suitable wire strand material, preferably annealed stainless steel wire. While four wire strands are used in the core of the yarn of the preferred embodiment shown, the number of wire strands can vary from 1 to 20 strands, but typically from 2 to 6 strands will be used. The wire strands 24 can range in diameter from 0.001 to 0.010 inch, the preferred range being from 0.002 to 0.006 inch in diameter, and the most preferred size is 0.003 inch in diameter. The preferred material is No. 304 stainless steel, fully annealed. Wire diameters smaller than 0.002 inch have a shorter life, are more expensive, and provide no significant advantage over larger diameters. Wire diameters greater than 0.006 inch have substantially less flexibility. The total diameter of the single wire strand or the plural wire strands grouped to form the core 22 should not exceed 0.02 inch, ignoring the fiber strand 26, and preferably will be less than .01 inch to facilitate a relatively small overall diameter of the yarn for knitting purposes. While stainless steel is a preferred wire material, especially for garments used in the food industry, where corrosion and food contamination must be avoided and frequent washing is required, other materials are useable in various applications; for example, steel, titanium and other metals may be used that are sufficiently flexible and strong to permit knitting of the yarn and use of the garment.

The parallel fiber strand 26 has high tensile strength, is relatively nonabsorbent, and is a multi-filament synthetic polymer fiber, advantageously of a denier of 800 to 1,500. Suitable core fibers include multi-filament fibers of polyester, aramid (aromatic polyamides), and polyamide. The preferred fiber is polyester of about 1000 denier, which avoids the disadvantages of aramid.

A multi-filament strand 26 in the core is advantageous. Multi-filament is continuous rather than spun and slides and/or flows with the other parts of the core during fabrication and subsequent use of an article of apparel produced with the yarn. The high strength multi-filament core strand takes a great deal, if not a major part, of the tensile load to which the yarn is subjected during knitting and use. The filament core strand also appears to increase the flexibility of the core part of the yarn over an all metal core and thus facilitates knitting. Also, a fiber core strand improves the basic quality of the yarn, promoting more even wrapping in the so-called "upwinding" of the yarn. Upwinding is the wrapping, of a cover strand about the core. With a wire core, the first winding or overwrap 28 tends to slip longitudinally and a fiber core strand provides much more uniformity in the close spacing or contact between the adjacent turns of a winding about the core. In addition, the presence of a fiber strand in the core acts as a cushion to help the cut-resistance of the wire.

The overwraps 28, 30 are preferably of synthetic polymer fiber, each in the form of a thread or strand made of twisted filaments. Fibers suitable for the overwraps are multi-filament or spun polyester or polyamide. Each strand 28, 30 is of a denier of 210 to 630, and in the preferred embodiment is about 440. The wraps 28, 30 are preferably polyester. While aramid and polyamide are advantageous in knitting high strength, cut-resistant gloves that are used in an uncoated form, those materials have been found to be disadvantageous when the glove is to be coated, as in the present invention. Aramid and polyamide are difficult to coat (i.e., to adhere a coating to) and, particularly in the case of aramid, are more expensive than polyester.

While a multi-filament wrap 28, 30 is preferred, it can be a spun filament with a cotton count of from 1 to 60, preferably from 15 to 35. Filament type fibers are preferred over spun fibers because they are stronger and less abrasive in knitting, and they are more resistant to cutting because the tensile strength is greater for any given denier.

Both overwraps 28, 30 are wound with successive turns directly adjacent, as shown. Each is wound in an opposite direction. While two overwraps are preferred, more are possible. It is, however, desirable to have an even number of overwraps for balanced tension. To facilitate use of the yarn in conventional knitting machines and to maintain flexibility in the end product, it is critical that the overall diameter of the yarn be no greater than 0.050 inch.

The fabric glove portion 13 is knitted rather than formed in other known manners, for flexibility, comfort, seamless construction, and efficiency of manufacture. Preferably it is knitted of a single yarn strand 12. The preferred yarn 12 is comprised of a core 22 of four strands 24 of 304 stainless steel each 0.003 inch in diameter and one parallel strand 26 of multi-filament polyester of 1000 denier with two overwraps 28, 30 of polyester multi-filament fiber strands of 440 denier helically wound in opposite directions. The total diameter of the preferred yarn is about 0.025 inch.

As an alternative to a single yarn, the shell 13 can be of a double yarn (i.e., knitted from two yarns 12, but smaller diameter yarn may then be desired to reduce the weight of the glove). A single yarn knit glove is more desirable in the present invention because the strength and cut resistance of the garment derives more from the metal strands in the core and the coating 16 over the fabric, than from the fiber overwraps 28, 30. Thus, the use of a slightly larger core with four metal strands and, hence, a larger diameter yarn, to form a single yarn knitted glove is more advantageous than using a thinner yarn and a double yarn knitting technique to form the glove. The opposite is true in the case of an uncoated glove in which the overwrap material is of substantially high strength and cut resistance, for example, aramid. A single yarn glove of the present construction is also more flexible and less expensive than a double yarn glove.

A second advantageous construction of the shell 13 utilizes an aramid fiber 26 of 1500 denier in the core and three rather than four stainless wires, each of 0.004 inch diameter, but otherwise the same as the preferred embodiment.

The liner 14, which is of cotton or other suitable fabric, such as polyester, provides increased comfort because of its softness and its ability to absorb perspiration. In fabricating the glove 10, a liner 14 is placed over a form to which it tightly conforms. The shell 13 is then placed over the liner and the liner and shell are dipped on the form into elastomeric coating material in liquid form. The material strikes through the knitted yarn of the shell 13, but preferably does not strike through the liner 14. It does however contact the liner 14 and bonds it in place within the shell 13 when the coating material solidifies or cures. The coated shell and adhered liner are removed from the form after curing and the liner and shell are then sewn together at the cuff end by the stitching 20.

Nitrile rubber is the preferred elastomeric coating material, because it is flexible even at low temperatures, stretchable, durable, oil and moisture resistant, tough and cut-resistant, and is relatively slip resistant. The term nitrile rubber includes acrylonitrile rubber, acrylonitrile butadiene rubber, nitrile-silicone rubber, which combines the characteristic properties of silicones with the oil resistance of nitrile rubber, acrylonitrile butadiene rubber, and nitrile butadiene rubber. The preferred nitrile rubber is carboxylated butadiene acrylic nitrile-copolymer latex furnished by Rycold Chemical Co. and includes zinc sulfur butylzymate, clay filler and pigment. Although nitrile rubber is preferred, other elastomers can be used, such as other synthetic polymers (including plastisols and organosols), and natural rubber (polyisoprene). The coating material is solidified or cured in situ, i.e., in place, after the knitted glove 13 is dipped and removed from the bath of the material. Techniques for coating fabric gloves with elastomeric materials are per se known and will be familiar to those skilled in the art.

In the preferred embodiment, the glove 13 is dipped in a manner to apply a continuous, solid (i.e., without exposed yarn) coating over the entire glove surface. Preferably, the coating thickness will be the minimum to provide complete fabric coverage and thereby preserve maximum flexibility and to assure a patterned surface, which is caused by the underlying, coated, shell yarn, which is loosely knitted. The coating thickness is sufficient to make the glove impermeable to liquid and is adequate to provide good wear and, further, is sufficiently thick to add substantially to the cut-resistance of the glove. Where rubber nitrile is used as the coating 16, and the glove is of the general construction shown in FIG. 1, the dry pick-up weight of the coating material for a medium size glove will typically be about 0.082 pounds. The weight of the shell is approximately 0.121 pounds and the liner 0.1051 pounds, the entire glove being quite light in weight for its strength, cut resistance and other attributes.

After the glove is dipped and removed from the coating material, curing of the nitrile rubber coating is accomplished by heating the coating on the shell to a curing temperature for sufficient time.

Improved slip resistance for gripping can be obtained by increasing the coefficient of friction of the palm and finger portions of the glove by incorporating into or adding an abrasive to the surface of the glove before the coating material is cured. Such a material may include pumice, by way of example. In addition, or alternatively, natural rubber or flock can be applied to the surface and/or a pattern can be impressed upon the glove in the palm and finger portions.

As compared with known aramid fiber gloves as disclosed in U.S. Pat. No. 4,004,295, U.S. Pat. Application Ser. No. 99,092 filed Nov. 30, 1979, which issued on May 24, 1983 as U.S. Pat. No. 4,384,449 and U.S. Pat. Application Ser. No. 891,611 filed Mar. 30, 1987, issued on Sept. 11, 1984 as U.S. Pat. No. 4,470,251 the present glove represents a different approach to cut resistance and provides the many advantages of the coating material. Aramid, for example, requires a chemical bond to facilitate coating and agents that provide such a bond are typically dangerous in food and would limit the uses of the glove. Also, the abrasiveness of aramid within the coating material causes deterioration of the yarn. Furthermore, use of a greater number of strands of wire 24 is made possible by using polyester rather than aramid in knitted products and especially knitted products that require flexibility, such as gloves. Because aramid essentially does not stretch, a yarn that uses four or more strands of wire becomes much too rigid for knitting and for most uses when aramid is used as a core and wrapping. With the present construction and the use of more stretchable polyester, additional wire of significant diameter imparts high cut resistance without unacceptable rigidity. In terms of strength, the flexibility and stretch of the core fiber, when the yarn is subjected to strain, allows the tensile strength of the increased quantity of steel to be utilized in resisting cutting. The flexibility of the yarn also allows use of an elastomeric coating without exceeding acceptable stiffness in the final product.

From the above, it will be apparent that a new and improved protective garment is provided, that is liquid proof and not absorbent to dirt, fats, oil, blood and other fluids, that is cut resistant, abrasion resistant, light in weight, flexible and comfortable to wear, and that is neither self-abrasive nor abrasive to other objects or clothing that it contacts (unless the coating is purposefully modified to increase friction). It also provides protection from heat. When the garment is in the form of a glove, it has a good feel and grip. While the glove industry has traditionally used layers of material to provide cut resistance and protection, the present garment provides an integral construction that is highly cut-resistant Its combined features meet a wide range of needs.

While a preferred embodiment of the invention has been disclosed in detail, various modifications and alterations may be made therein without departing from the spirit and scope of the invention set forth in the appended claims.

We claim:

1. A protective glove comprised of a cover having wire strands, and a fabric liner, and a continuous coating of elastomeric material permeating the cover and adhering the liner and cover together, the improvement wherein the cover is knit from yarn comprised of a core having 2 to 6 strands of stainless steel wire and a parallel synthetic polymer fiber strand having a denier ob 800 to 1500, the overall diameter of the wire strands being no greater than 0.020 inch, and strands, all of which are nonaramid fiber, having a denier of 210 to 630, wrapped about the core in opposite directions one on top of the other, the total diameter of the yarn being no greater than 0.050 inch.

2. A protective glove of knitted yarn covered with a coating of elastomeric material cured in place and having a fabric liner bonded in place with the coating, the improvement wherein said yarn has a core comprised of four strands of stainless steel wire about 0.003 inch in diameter and a parallel strand of synthetic polymer fiber having a denier of 800 to 1500, the overall diameter of said core wire being no greater than 0.020 inch and said yarn has wrapping strands, all of which are nonaramid fiber having a denier of 210 to 630 wrapped about the core in opposite directions one on top of the other, at least the outer strand of which is polyester, the total diameter of the yarn being no greater than about 0.050 inch, said glove being highly cut-resistant, nonabsorbent to dirt, fat, blood and the like, with high slip resistance and good feel to the wearer, and light in weight, stretchable and flexible.

3. A protective glove as set forth in claim 2 wherein the core fiber has a denier of about 1000 and the two strands wrapped about the core have a denier of about 440.

4. A protective garment, shaped to cover the extremity of a limb, comprised of a cover having wire strands, a fabric liner, and a continuous coating of elastomeric material permeating the cover and adhering the liner and cover together, the improvement wherein the cover is knit from yarn comprised of a core having 2 to 6 strands of stainless steel wire and a parallel synthetic polymer fiber strand having a denier of 800 to 1500, the overall diameter of the wire strands being no greater than 0.020 inch, and strands, all of which are nonaramid fiber, having a denier of 210 to 630, wrapped about the core in opposite directions one on top of the other, the total diameter of the yarn being no greater than 0.050 inch.

5. A protective garment as set forth in claim 4 wherein an outer one of the strands wrapped around the core is polyester.

6. A flexible protective garment, shaped to cover the extremity of a limb, comprised of a fabric liner, a cover having wire strands over the liner, and a coating of elastomeric material permeating the cover and adhering the liner and cover together, the improvement wherein the cover is a garment shell knit from yarn comprised of a core having at least one strand of stainless steel wire 0.001 to 0.01 inch in diameter and a synthetic polymer fiber strand, and strands, all of which are nonaramid fiber, wrapped about the core in opposite directions one on top of the other.

7. A protective garment as set forth in claim 6 wherein the strands wrapped around the core are polyester.

8. A protective garment as set forth in claim 6 wherein there are two strands wrapped around the core and the outer strand is polyester.

9. A protective garment as set forth in claims 6, 7 or 8 wherein the core includes 2 to 6 strands of stainless steel wire 0.002 to 0.006 inch in diameter, the overall diameter of the wire strands being no greater than 0.020 inch.

10. A protective garment as set forth in claim 9 wherein the wrapping strands have a denier of 210 to 630.

11. A protective garment as set forth in claim 9 wherein the protective garment is a cut-resistant glove.

12. A protective glove comprised of an inner glove-shaped fabric, a metal-wire-containing over-lay on the fabric and an elastomeric coating covering the overlay and bonding it to the fabric, the improvement wherein the overlay is knitted of yarn having a core of at least one wire strand and one fiber strand; and wrappings, all of which are nonaramid fiber, about the core, one on top of the other, the outer of which adheres strongly to the coating; said glove being flexible and highly cut resistant.

13. A glove as set forth in claim 12 wherein the overlay is knit into a glove form that closely surrounds the inner fabric and wherein the wrappings include an outer one of polyester.

14. A protective material comprising:

a base layer of textile material;

an intermediate layer of relatively cut-resistant, fiber material formed from intermeshing strands, defining pores therebetween, an outer layer of solid, elastomeric material which retards penetration by liquid;

said pores in said intermediate layer being sufficiently large to permit the passage therethrough of said elastomeric material when the latter is in a liquid state;

said base layer being sufficiently non-porous to prevent the passage entirely therethrough of said elastomeric material when the latter is in a liquid state;

said solid, elastomeric material extending through said intermediate layer, filling the pores in said intermediate layer and substantially totally encapsulating the strands of said intermediate layer;

the bond between the base layer and the intermediate layer consisting essentially of said elastomeric material.

15. A protective material as recited in claim 14 wherein:

said base layer is composed of fiber material capable of bonding to said elastomeric material.

16. A protective material as recited in claim 14 wherein:

said base layer is composed of fiber material having sufficient absorbency to hold a coagulant for said elastomeric material when the latter is in a liquid state.

17. A protective material as recited in claim 14 wherein:

said textile material of said base layer comprises at least a predominance of cotton.

18. A protective material as recited in claim 14 wherein:

said solid, elastomeric material partially penetrates said base layer to assist in the bonding thereof.

19. A protective material as recited in claim 14 wherein:

said strands of said intermediate layers comprise:

an interior, metallic spine; and a nonmetallic, exterior composed of textile fibers enclosing said spine.

20. A protective material as recited in claim 14 wherein:

said elastomeric material comprises at least one of acrylonitrile butadiene rubber, polyvinyl chloride, polychloroprene, and natural rubber.

21. A protective material as recited in claim 14 wherein:

said intermediate layer is sandwiched between said base layer and said outer layer.

22. An article of apparel composed at least in part of the protective material of claim 14.

23. An article of apparel as recited in claim 22 wherein:

said article is a glove having a cuff edge;

and said base layer and said intermediate layer are sewn together solely at said cuff edge.

24. A protective material as recited in claim 14 wherein:

said solid, elastomeric material covers said base layer.

25. A protective material as recited in claim 14 wherein:

said outer layer is liquid impervious.

26. A method for producing an article composed of protective material comprising a base layer of textile material, an intermediate layer of relatively cut-resistant fiber material and an outer layer of solid, elastomeric material which retards penetration by liquid, said method comprising the steps of:

providing said base layer in the form of textile material which is sufficiently nonporous to prevent the passage entirely therethrough of said elastomeric material when the latter is in a liquid state and which will bond to the elastomeric material;

conforming said base layer to a predetermined shape dictated by the shape of said article;

providing said intermediate layer in a form having intermeshing strands defining pores therebetween sufficiently large to permit the passage therethrough of said elastomeric material when the latter is in a liquid state;

mounting said intermediate layer exteriorly to said base layer to conform the shape of said intermediate layer to the shape of the underlying base layer;

providing said elastomeric material in a liquid state;

dipping the base layer and mounted intermediate layer into said elastomeric material;

said dipping step comprising flowing said liquid elastomeric material through said pores in said intermediate layer to cover said base layer, fill said pores and substantially totally encapsulate said strands with said elastomeric material;

solidifying the liquid, elastomeric material and bonding it to said base layer while the elastomeric material covers the base layer, fills the pores in said intermediate layer and substantially totally encapsulates the strands in the intermediate layer;

the bonding between said intermediate layer and said base layer consisting essentially of said elastomeric material.

27. A method as recited in claim 26 wherein: said dipping step is conducted for a period of time which permits said liquid elastomeric material to flow through the pores in the intermediate layer to cover the base layer, fill the pores in the intermediate layer and encapsulate the strands in the intermediate layer with elastomeric material.

28. A method as recited in claim 26 wherein said conforming steps comprise:

providing a mold having a predetermined shape dictated by the shape of said article;

mounting said base layer on said mold to conform the base layer to the shape of the mold;

and mounting said intermediate layer exteriorly of the base layer when the latter is on the mold.

29. A method as recited in claim 26 wherein:

said liquid elastomeric material partially penetrates said base layer.

30. A method as recited in claim 26 wherein said article is a glove having a cuff edge and wherein said method comprises:

sewing said base layer and said intermediate layer together solely at said cuff edge.

* * * * *